US006422929B1

(12) United States Patent
Jang et al.

(10) Patent No.: US 6,422,929 B1
(45) Date of Patent: Jul. 23, 2002

(54) POLISHING PAD FOR A LINEAR POLISHER AND METHOD FOR FORMING

(75) Inventors: Syun-Ming Jang, Hsin-Chu; Ying-Ho Chen, Taipei, both of (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 0 days.

(21) Appl. No.: 09/541,070

(22) Filed: Mar. 31, 2000

(51) Int. Cl.[7] ..... B24B 21/00; B24B 11/00

(52) U.S. Cl. ..... 451/296; 451/526; 451/530; 451/533

(58) Field of Search ..... 451/296, 526, 451/527, 530, 533, 539

(56) References Cited

U.S. PATENT DOCUMENTS 5,020,283 A * 6/1991 Tuttle ..... 451/527
5,297,364 A * 3/1994 Tuttle ..... 451/527
6,165,904 A * 12/2000 Kim ..... 438/692
6,238,271 B1 * 5/2001 Cesna ..... 451/41
6,238,273 B1 * 5/2001 Southwick ..... 451/41
6,245,406 B1 * 6/2001 Kuramochi et al. ..... 451/539
6,257,973 B1 * 7/2001 Fernand Guiselin ..... 451/539
6,261,168 B1 * 7/2001 Jensen et al. ..... 451/527

FOREIGN PATENT DOCUMENTS

GB 2043501 * 10/1980 ..... 451/527

* cited by examiner

*Primary Examiner*—M. Rachuba
(74) *Attorney, Agent, or Firm*—Tung & Associates

(57) ABSTRACT

A polishing pad for use in a linear polisher, and more specifically, for a linear chemical mechanical polishing apparatus that has improved polishing uniformity is described. The polishing pad is provided with a top surface for engaging a wafer surface to be polished. The top surface has a center portion and two oppositely situated edge portions. The polishing pad is further provided with a multiplicity of voids situated in the top surface of the pad body such that the top surface has a void-to-surface ratio that is greater in the two edge portions than in the center portion of the top surface. The present invention novel polishing pad provides a more uniform polishing across a wafer surface, together with an improved planarity after polishing.

16 Claims, 4 Drawing Sheets

POLISHING PAD FOR A LINEAR POLISHER AND METHOD FOR FORMING

FIELD OF THE INVENTION

The present invention generally relates to a polishing pad for a chemical mechanical polishing apparatus and a method for forming the pad and more particularly, relates to a polishing pad for a linear chemical mechanical polishing apparatus for achieving improved polishing uniformity and a method for forming the pad.

BACKGROUND OF THE INVENTION

In the fabrication of semiconductor devices from a silicon wafer, a variety of semiconductor processing equipment and tools are utilized. One of these processing tools is used for polishing thin, flat semiconductor wafers to obtain a planarized surface. A planarized surface is highly desirable on a shadow trench isolation (STI) layer, on an inter-layer dielectric (ILD) or on an inter-metal dielectric (IMD) layer which are frequently used in memory devices. The planarization process is important since it enables the use of a high resolution lithographic process to fabricate the next level circuit. The accuracy of a high resolution lithographic process can be achieved only when the process is carried out on a substantially flat surface. The planarization process is therefore an important processing step in the fabrication of semiconductor devices.

A global planarization process can be carried out by a technique known as chemical mechanical polishing or CMP. The process has been widely used on ILD or IMD layers in fabricating modern semiconductor devices. A CMP process is performed by using a rotating platen in combination with a pneumatically actuated polishing head. The process is used primarily for polishing the front surface or the device surface of a semiconductor wafer for achieving planarization and for preparation of the next level processing. A wafer is frequently planarized one or more times during a fabrication process in order for the top surface of the wafer to be as flat as possible. A wafer can be polished in a CMP apparatus by being placed on a carrier and pressed face down on a polishing pad covered with a slurry of colloidal silica or aluminum.

A polishing pad used on a rotating platen is typically constructed in two layers overlying a platen with a resilient layer as an outer layer of the pad. The layers are typically made of a polymeric material such as polyurethane and may include a filler for controlling the dimensional stability of the layers. A polishing pad is typically made several times the diameter of a wafer in a conventional rotary CMP, while the wafer is kept off-center on the pad in order to prevent polishing a non-planar surface onto the wafer. The wafer itself is also rotated during the polishing process to prevent polishing a tapered profile onto the wafer surface. The axis or rotation of the wafer and the axis of rotation of the pad are deliberately not collinear, however, the two axes must be parallel. It is known that uniformity in wafer polishing by a CMP process is a function of pressure, velocity and concentration of the slurry used.

A CMP process is frequently used in the planarization of an ILD or IMD layer on a semiconductor device. Such layers are typically formed of a dielectric material. A most popular dielectric material for such usage is silicon oxide. In a process for polishing a dielectric layer, the goal is to remove typography and yet maintain good uniformity across the entire wafer. The amount of the dielectric material removed is normally between about 5000 Å and about 10,000 Å. The uniformity requirement for ILD or IMD polishing is very stringent since non-uniform dielectric films lead to poor lithography and resulting window etching or plug formation difficulties. The CMP process has also been applied to polishing metals, for instance, in tungsten plug formation and in embedded structures. A metal polishing process involves a polishing chemistry that is significantly different than that required for oxide polishing.

The important component needed in a CMP process is an automated rotating polishing platen and a wafer holder, which both exert a pressure on the wafer and rotate the wafer independently of the rotation of the platen. The polishing or the removal of surface layers is accomplished by a polishing slurry consisting mainly of colloidal silica suspended in deionized water or KOH solution. The slurry is frequently fed by an automatic slurry feeding system in order to ensure the uniform wetting of the polishing pad and the proper delivery and recovery of the slurry. For a high volume wafer fabrication process, automated wafer loading/unloading and a cassette handler are also included in a CMP apparatus.

As the name implies, a CMP process executes a microscopic action of polishing by both chemical and mechanical means. While the exact mechanism for material removal of an oxide layer is not known, it is hypothesized that the surface layer of silicon oxide is removed by a series of chemical reactions which involve the formation of hydrogen bonds with the oxide surface of both the wafer and the slurry particles in a hydrogenation reaction; the formation of hydrogen bonds between the wafer and the slurry; the formation of molecular bonds between the wafer and the slurry; and finally, the breaking of the oxide bond with the wafer or the slurry surface when the slurry particle moves away from the wafer surface. It is generally recognized that the CMP polishing process is not a mechanical abrasion process of slurry against a wafer surface.

While the CMP process provides a number of advantages over the traditional mechanical abrasion type polishing process, a serious drawback for the CMP process is the difficulty in controlling polishing rates and different locations on a wafer surface. Since the polishing rate applied to a wafer surface is generally proportional to the relative velocity of the polishing pad, the polishing rate at a specific point on the wafer surface depends on the distance from the axis of rotation. In other words, the polishing rate obtained at the edge portion of the wafer that is closest to the rotational axis of the polishing pad is less than the polishing rate obtained at the opposite edge of the wafer. Even though this is compensated by rotating the wafer surface during the polishing process such that a uniform average polishing rate can be obtained, the wafer surface, in general, is exposed to a variable polishing rate during the CMP process.

More recently, a new chemical mechanical polishing method has been developed in which the polishing pad is not moved in a rotational manner but instead, in a linear manner. It is therefor named as a linear chemical mechanical polishing process in which a polishing pad is moved in a linear manner in relation to a rotating wafer surface. The linear polishing method affords a uniform polishing rate across a wafer surface throughout a planerization process for uniformly removing a film player of the surface of a wafer. One added advantage of the linear CMP system is the simpler construction of the apparatus and therefore not only reducing the cost of the apparatus but also reduces the floor space required in a clean room environment.

A typical linear CMP apparatus 10 is shown in FIGS. 1A and 1B. The linear CMP apparatus 10 is utilized for polishing a semiconductor wafer 24, i.e. a silicon wafer for removing a film layer of either an insulating material or a wafer from the wafer surface. For instance, the film layer to be removed may include insulating materials such as silicon oxide, silicon nitrite or spin-on-glass material or a metal layer such as aluminum, copper or tungsten. Various other materials such as metal alloys or semi-conducting materials such as polysilicon may also be removed.

As shown in FIGS. 1A and 1B, the wafer 24 is mounted on a rotating platform, or wafer holder 18 which rotates at a pre-determined speed. The major difference between the linear polisher 10 and a conventional CMP is that a continuous, or endless belt 12 is utilized instead of a rotating polishing pad. The belt 12 moves in a linear manner in respect to the rotational surface of the wafer 24. The linear belt 12 is mounted in a continuous manner over a pair of rollers 14 which are, in turn, driven by a motor means (not shown) at a pre-determined rotational speed. The rotational motion of the rollers 14 is transformed into a linear motion 26 in respect to the surface of the wafer 24. This is shown in FIG. 1B.

In the linear polisher 10, a polishing pad 30 is adhesively joined to the continuous belt 12 on its outer surface that faces the wafer 24. A polishing assembly 40 is thus formed by the continuous belt 12 and the polishing pad 30 glued thereto. As shown in FIG. 1A, a plurality of polishing pads 30 are utilized which are frequently supplied in rectangular-shaped pieces with a pressure sensitive layer coated on the back side.

The wafer platform 18 and the wafer 24 forms an assembly of a wafer carrier 28. The wafer 24 is normally held in position by a mechanical retainer, commonly known as a retaining ring 16, as shown in FIG. 1B. The major function of the retaining ring 16 is to fix the wafer in position in the wafer carrier 28 during the linear polishing process and thus preventing the wafer from moving horizontally as wafer 24 contacts the polishing pad 30. The wafer carrier 28 is normally operated in a rotational mode such that a more uniform polishing on wafer 24 can be achieved. To further improve the uniformity of linear polishing, a support housing 32 is further utilized to provide support to support platen 22 during a polishing process. The support platen 22 provides a supporting platform for the underside of the continuous belt 12 to ensure that the polishing pad 30 makes sufficient contact with the surface of wafer 24 in order to achieve more uniform removal in the surface layer. Typically, the wafer carrier 28 is pressed downwardly against the continuous belt 12 and the polishing pad 30 at a predetermined force such that a suitable polishing rate on the surface of wafer 24 can be obtained. A desirable polishing rate on the wafer surface can therefore by obtained by suitably adjusting forces on the support housing 32, the wafer carrier 28, and the linear speed 26 of the polishing pad 30. A slurry dispenser 20 is further utilized to dispense a slurry solution 34.

In the conventional linear polisher 10, the polishing pads 30 are joined to the continuous belt 12 by adhesive means such as by a pressure sensitive. In a typical linear polisher, since the continuous belt 12 may have a length of about 240 cm, while the polishing pads 30 cannot be supplied in the form of a continuous manner, many pieces of the polishing pads 30 must be used. In other words, seam lines between adjacent polishing pads 30 must be formed when joined to the continuous belt 12. For instance, when the polishing pads are supplied in length of only about 30~40 cm, between five and seven pieces of the polishing pads must be utilized.

The linear chemical mechanical polishing method provides the advantages of a high belt speed, a low compression force on the sample and the flexibility of using either a hard pad or a soft pad. However, a good planarity is achieved by the linear CMP method at the expense of polishing uniformity across a wafer surface. The poor polishing uniformity across the wafer surface is caused by the pattern of voids or protrusions utilized on a polishing pad in linear CMP. This is shown in FIGS. 2A, 2B and 2C.

As shown in FIG. 2A, the polishing pad 30 is formed of a pad body 42 which has a top surface 44 and a bottom surface 46. It should be noted that in FIG. 2A, only a section of a polishing pad 30 is shown. The top surface 44 of the pad body 42 is provided with a multiplicity of grooves 50, each having a pre-determined width and depth. The depth of the grooves 50 is normally smaller than the thickness of the pad body 42. FIG. 2B shows a similar pad body 42 but is provided with a multiplicity of apertures 52, i.e. perforations through the pad body 42. The diameter of each aperture in the multiplicity of apertures 52 is essentially the same. In another configuration, as shown in FIG. 2C, the pad body 42 is provided with a multiplicity of protrusions 54, i.e. mesas with grooves 56 thereinbetween. The multiplicity of protrusions 54 are formed to a pre-determined thickness, i.e. to less than 3 mm. The top surface 58 of the multiplicity of protrusions 54 contacts a wafer surface during the linear CMP process.

In the conventional polishing pad 30 shown in FIGS. 2A, 2B and 2C, the polishing rate on a wafer surface contacting the top surface 44 of the pad is different across the wafer surface. For instance, it was found that at near the center line 60 of the pad body 42, polishing rate obtained is lower than the polishing rate obtained at two edge portions 62,64. The varying polishing rates across the width of the polishing pad 30 therefore causes poor uniformity on a wafer surface being polished. When the surface grooves 52 are of the same width (FIG. 2A), the apertures 52 are all the same diameter (FIG. 2B), or when the protrusions 54 are of the same size (FIG. 2C), a poor uniformity in the thickness removed from the wafer surface is obtained. This is further shown in FIG. 4 by curves A and A'. Curve A indicates the thickness of a copper material being removed as a function of the position on a wafer measured from the wafer center, while curve A' indicates the data scattering during the test. It is seen, in FIG. 4, that at the center of the wafer, lesser copper material (about 7,300 Å)is removed, while at the two edges of the wafer, significantly more copper material (about 8,600 Å) is removed. The thickness variation on the same wafer surface is therefore about 20% when obtained at the wafer edge is compared to data obtained at the wafer center.

It is therefore an object of the present invention to provide a polishing pad for a linear polisher that does not have the drawbacks or shortcomings of a conventional linear polishing pad.

It is another object of the present invention to provide a polishing pad for a linear polisher for achieving improved polishing uniformity on a wafer surface.

It is a further object of the present invention to provide a polishing pad for a linear polisher for achieving both good planarity and good uniformity on a wafer surface.

It is another further object of the present invention to provide a polishing pad for a linear polisher that has a surface pattern varies with locations on the pad for compensating location dependency of the removal rates.

It is still another object of the present invention to provide a polishing pad for use in a linear polisher for achieving improved polishing uniformity by providing a larger void-to-surface ratio along the edges of the polishing pad.

It is yet another object of the present invention to provide a polishing pad for use in a linear chemical mechanical polishing apparatus that utilizes wider grooves in the polishing pad surface along the edges of the pad.

It is still another further object of the present invention to provide a polishing pad for use in a linear chemical mechanical polishing apparatus by providing more surface grooves in the polishing surface along the edges of the polishing pad when compared to the center of the polishing pad.

It is yet another further object of the present invention to provide a polishing pad for use in a linear chemical mechanical polishing apparatus by providing apertures of larger diameters along the edges of the polishing pad when compared to the center of the polishing pad.

SUMMARY OF THE INVENTION

In accordance with the present invention, a polishing pad for use in a chemical mechanical polishing apparatus for achieving improved polishing uniformity and a method for fabricating such pads are disclosed.

In a preferred embodiment, a polishing pad for use in a linear CMP apparatus is provided which includes a pad body that has a top surface for engaging a surface to be polished and a bottom surface for mounting to a linear belt, the top surface has a center portion and two oppositely situated edge portions, and a multiplicity of voids situated in the top surface of the pad body such that the top surface has a void-to-surface ratio, the void-to-surface ratio is greater in the two edge portions when compared to the center portion of the top surface.

In the polishing pad for use in a linear CMP apparatus, the multiplicity of voids is selected from the group consisting of a multiplicity of linear grooves, a multiplicity of apertures and a multiplicity of grooves formed in-between a multiplicity of protrusions. The padded body may be formed of a polymeric material. The void-to-surface ratio may be greater than 20% in the edge portions of the top surface, and smaller than 20% in the center portion of the top surface. The multiplicity of linear grooves includes at least a first multiplicity of linear grooves in the edge portions and a second multiplicity of linear grooves in the center portion, each of the first multiplicity of linear grooves has a width that is larger than a width of the second multiplicity of linear grooves. The multiplicity of linear grooves includes at least a first multiplicity of linear grooves in the edge portions and a second multiplicity of linear grooves in the center portion, the first multiplicity is larger than the second multiplicity, the first multiplicity of linear grooves and the second multiplicity of linear grooves may have the same width. The multiplicity of linear grooves each has a depth smaller than a thickness of the pad body, or a depth smaller than ½ of a thickness of the pad body.

In the polishing pad for use in a linear chemical mechanical polishing apparatus, the multiplicity of apertures may include at least a first multiplicity of apertures in the edge portions and a second multiplicity of apertures in the center portion, each of the first multiplicity of apertures may have a diameter larger than a diameter of the second multiplicity of apertures, the first multiplicity may be larger than the second multiplicity, and furthermore, the first multiplicity of apertures and the second multiplicity of aperture may have the same diameter. The multiplicity of apertures may be perforations through the pad body, or each may have a depth smaller than a thickness of the pad body. The multiplicity of grooves formed in between a multiplicity of protrusions may be a multiplicity of grooves formed in-between a multiplicity of mesas. The multiplicity of protrusions each may have a height of not more than 3 mm. The multiplicity of protrusions may include a first multiplicity of protrusions in the edge portions and a second multiplicity of protrusions in the center portion, each of the first multiplicity of protrusions may have an area smaller than an area for the second multiplicity of protrusions, or the first multiplicity may be greater than the second multiplicity.

The present invention is further directed to a method for forming a polishing pad for use in a linear polisher which can be carried out by the operating steps of first providing a pad body that has a top surface for engaging a surface to be polished and a bottom surface for mounting to a linear belt, the top surface may have a center portion and two oppositely situated edge portions, and forming a multiplicity of voids situated in the top surface of the pad body such that the top surface has a void-to-surface ratio, the void-to-surface ratio is greater in the two edged portions than in the center portion of the top surface.

In the method for forming a polishing pad for use in a linear polisher, the multiplicity of voids may be formed in a configuration that is selected from the group consisting of a multiplicity of linear grooves, a multiplicity of apertures and a multiplicity of grooves formed in-between a multiplicity of protrusions.

BRIEF DESCRIPTION OF THE DRAWINGS

In the drawings, which form an integral part of the specifications, and are to be read in conjunction therewith, and in which like components are designated by identical numerals in the various views.

DETAILED DESCRIPTION OF THE PREFERRED EMBODIMENT

The present invention discloses a polishing pad for a linear polisher for achieving polishing uniformity. While the polishing pad can be used in any type of linear polisher, it is particularly suitable for use in a linear chemical mechanical polishing apparatus.

The polishing pad for use in a linear polisher for achieving improved polishing uniformity may be constructed by a pad body that has a top surface for engaging a wafer surface to be polished and a bottom surface for mounting to a linear belt. A suitable mounting method is by adhesive means. The top surface has a center portion and two oppositely situated edge portions. The polishing pad further includes a multiplicity of voids situated in a top surface of the pad body such that the top surface has a void-to-surface ratio that is greater in the two edge portions than in the center portion of the top surface.

The multiplicity of voids in the cop surface of the polishing pad may be constructed in various configurations, i.e. in a multiplicity of linear grooves, in a multiplicity of apertures, or in a multiplicity of grooves formed in-between a multiplicity of protrusions. The void-to-surface ratio may be greater than 20% in the edge portions of the top surface, and smaller than 20% in the center portion of the top surface.

The present invention also discloses a method for forming a polishing pad for use in a linear polisher that can be carried out by the operating steps of first providing a pad body that has a top surface for engaging a wafer surface to be polished and a bottom surface for mounting to a linear belt by adhesive means, the top surface may have a center portion and two oppositely situated edge portions. A multiplicity of voids in the top surface is then formed in the pad body such that the top surface has a void-to-surface ratio that is greater in the two edge portions than in the center portion. The method may further include the step of forming the multiplicity of voids in a configuration that is selected from a multiplicity of linear grooves of shallow depth, a multiplicity of apertures in the form of perforations through the pad body, or a multiplicity of grooves formed in between a multiplicity of protrusions or mesas.

Figure 1A:
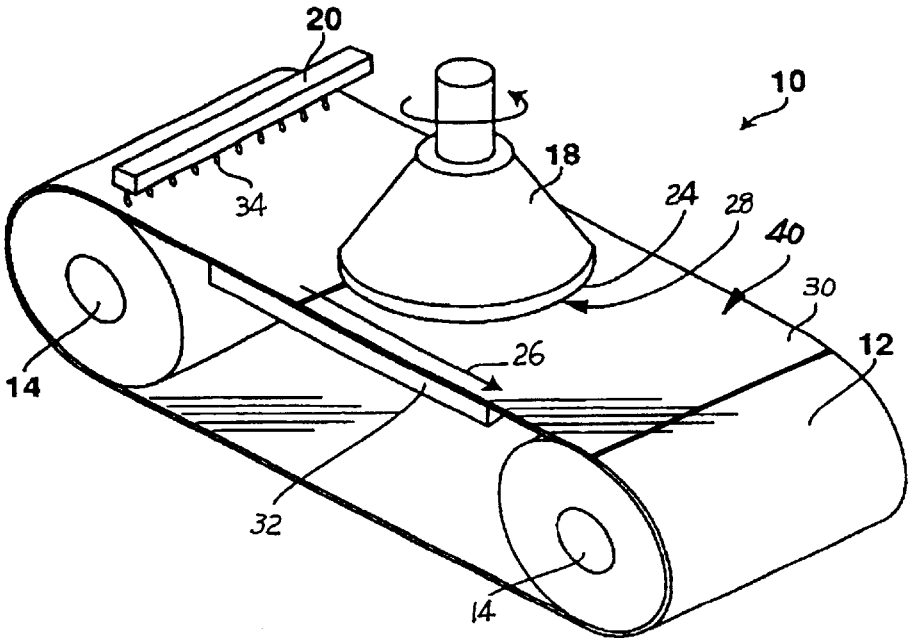
Fig 1A (Prior Art)
FIG. 1A is a prospective view of a conventional linear chemical mechanical polishing apparatus utilizing a continuous belt.
Figure 1B:
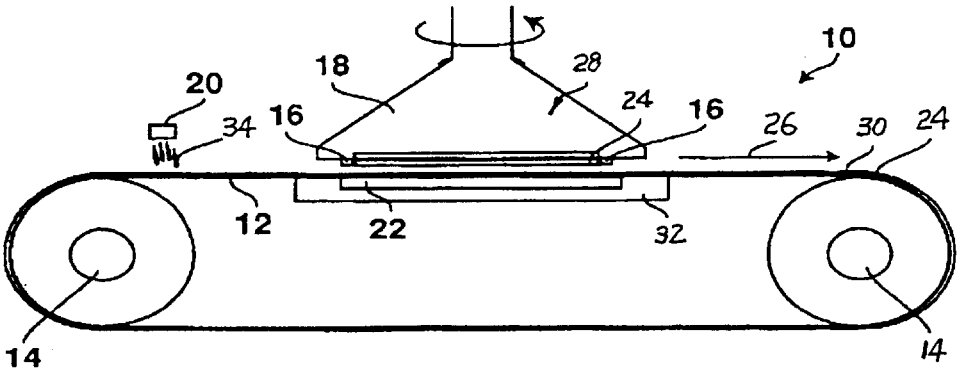
Fig 1B (Prior Art)
FIG. 1B is a side view of the conventional linear chemical mechanical polishing apparatus of FIG. 1A.
Figure 2:
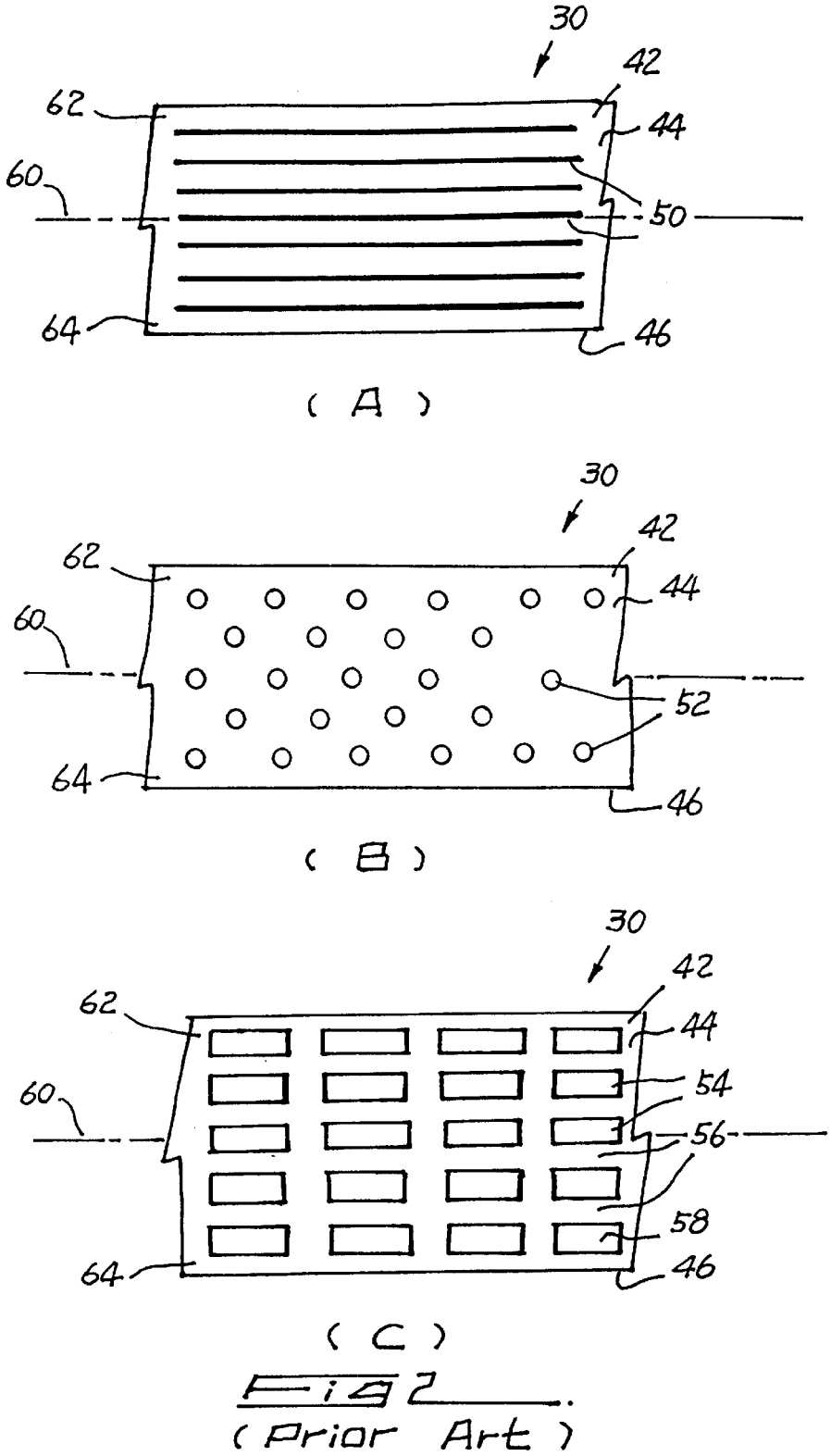
Fig 2 (Prior Art)
FIG. 2A is a plane view of a section of a conventional polishing pad with a multiplicity of grooves formed in a top surface.
FIG. 2B is a plane view of a section of a conventional polishing pad with a multiplicity of apertures formed through the pad.
FIG. 2C is a plane view of a section of a conventional polishing pad with a multiplicity of protrusions formed on the pad surface.
Figure 3:
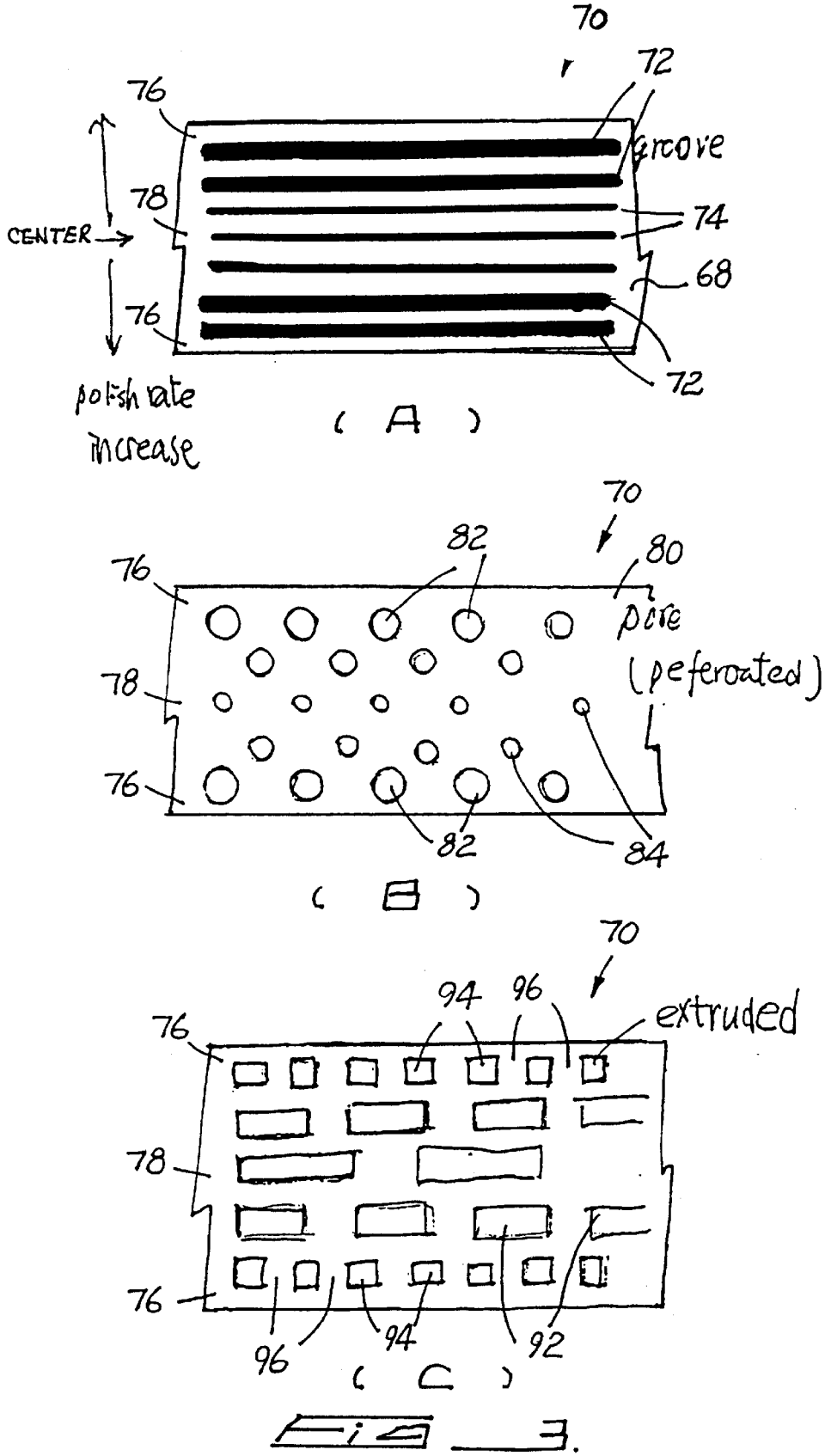
FIG. 3A is a plane view of a section of the present invention polishing pad having surface grooves of different widths formed in a top surface.
FIG. 3B is a plane view of a section of the present invention polishing pad having apertures of different sizes formed through the pad.
FIG. 3C is a plane view of a section of the present invention polishing pad having a multiplicity of protrusions of different sizes formed on a top surface.

Referring now to FIGS. 3A, 3B and 3C which show three different embodiments of the present invention novel polishing pad. As shown in FIG. 3A, in a first preferred embodiment of polishing pad 70, a first multiplicity of surface grooves 72 and a second multiplicity of surface grooves 74 are provided in a top surface 68 of the pad. For instance, the width of the first multiplicity of surface grooves 72 may be larger than 1 mm, while the width of the second multiplicity of surface grooves 74 may be smaller than 1 mm. The difference in the width of the surface grooves 72,74 results in a void-to-surface ratio (defined by the total surface area occupied by the void divided by the total surface area occupied by the void and by the top surface 68) that is greater than 20% in the edge portions 76 and smaller than 20% in the center portion 78 of the top surface.

The present invention novel surface grooves of different sizes is design based on the assumption that the polish rate on the wafer surface is a function of the pattern size and density. In other words, larger grooves or more grooves results in higher removal rate on the wafer surface. When apertures, instead of grooves are utilized, larger apertures or more apertures results in higher removal rate. It is theorized that the higher removal rate is attributed to a larger volume of slurry solution transported through the large grooves or larger apertures in the present invention polishing pad when compared to the conventional pad. Furthermore, higher removal rate may also be attributed to the larger number of grooves or larger number of apertures for allowing a larger volume of slurry solution to be transported therethrough.

The depth of the surface grooves 72,74 may be suitably determined at less than 3 mm, or preferably at less than 1 mm. It should be noted that, as shown in FIG. 3A, while only two groups of different sized surface grooves are provided, the present invention novel method is not limited to such configuration, i.e. surface grooves of more than two different sizes may be utilized.

Referring now to FIG. 3B, wherein a present invention polishing pad 70 that is provided with a first multiplicity of apertures 82 and a second multiplicity of apertures 84 in pad body 80 is shown. The multiplicity of apertures 82,84 may be perforations through the pad body 80, or may be blind holes formed in the pad body 80. The diameters of the first multiplicity of apertures 82 and the second multiplicity of apertures 84 are sufficiently different such that the polishing rates achieved by the polishing pad 70 can be more uniform across the pad. The diameters of the multiplicity of apertures 82,84 are arranged such that void-to-surface ratio at the edge portions 76 is more than 20 percent, while the void-to-surface ratio at the center portion 78 is less than 20%.

In a third preferred embodiment of the present invention, shown in FIG. 3C, the polishing pad 70 is equipped with a first multiplicity of protrusions 94 and a second multiplicity of protrusions 92. The protrusions may be formed in the shape of mesas by an extrusion method. A suitable height for the first and second multiplicity of protrusions 92,94 may be less than 5 mm and preferably less than 3 mm. It should be noted, as shown in FIG. 3C, the grooves 96 formed in-between the protrusions 92,94 are used as channels for transporting a slurry solution therethrough. In the edge portions 76, the first multiplicity of protrusions 94 are formed in smaller areas such that there are more grooves 96 formed thereinbetween to allow a larger volume of slurry solution to flow through. This contributes to a higher, improved removal rate at the edge portion 76 of the polishing pad 70. A suitable dimension for the first multiplicity of protrusions 94 may be about 5 mm×5 mm.

Figure 4:
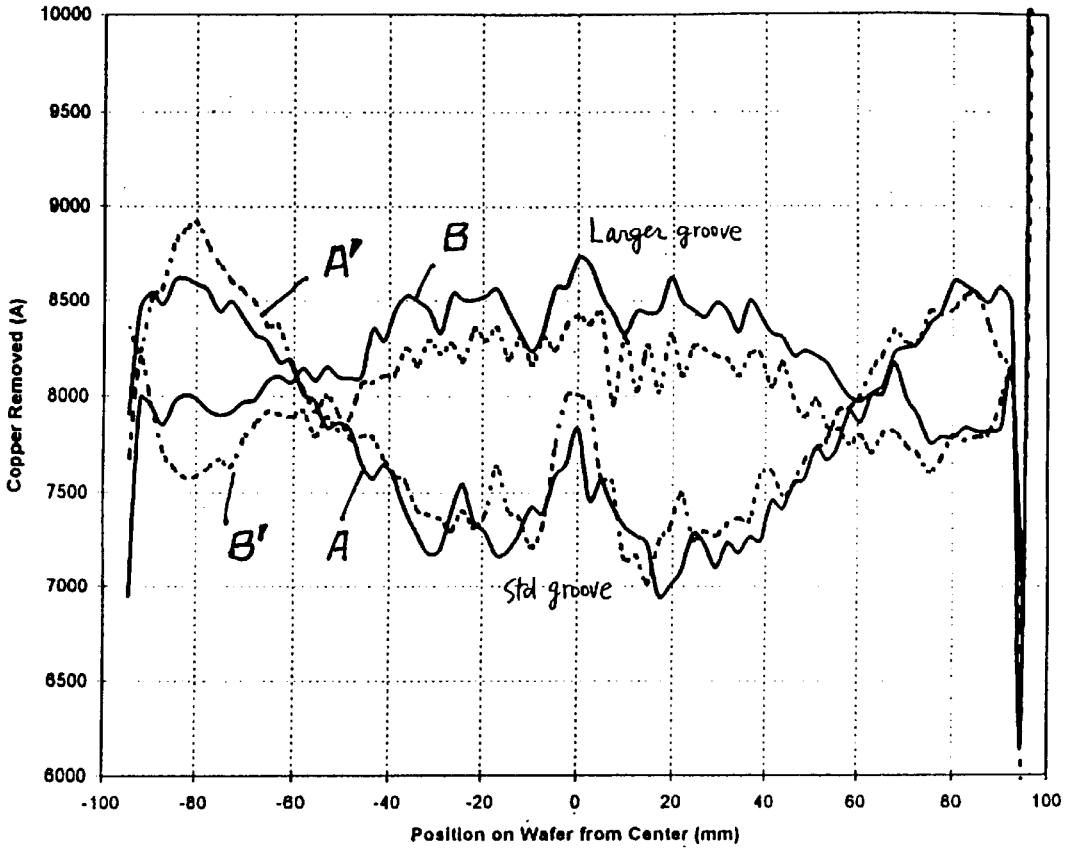
FIG. 4 is a graph illustrating the thicknesses of material removed as a dependence on distances from a wafer center obtained on a conventional polishing pad and on a present invention polishing pad.

The effectiveness of the present invention novel polishing pad 70 that is equipped with a first multiplicity of voids and a second multiplicity of voids of different sizes is shown in FIG. 4. The curves B and B' represent average values and data scattering of the removal rates of copper from a wafer surface plotted as a dependence on the distance from the wafer center. It is seen that thickness of copper removed is between about 8,000 Å and about 8,700 Å, i.e. representing a significant improvement in surface uniformity obtained across a wafer surface. The thickness variation of about 700 Å is less than half of that shown by curves A and A' for the conventional polishing pad, i.e. a thickness variation of about 1,500 Å.

The present invention novel polishing pad for a linear chemical mechanical polishing apparatus for achieving improved polishing uniformity and a method for forming such pad have therefore been amply described in the above description and in the appended drawings of FIGS. 3A, 3B, 3C and 4.

While the present invention has been described in an illustrative manner, it should be understood that the terminology used is intended to be in a nature of words of description rather than of limitation.

Furthermore, while the present invention has been described in terms of a preferred and alternate embodiment, it is to be appreciated that those skilled in the art will readily apply these teachings to other possible variations of the inventions.

The embodiment of the invention in which an exclusive property or privilege is claimed are defined as follows:

What is claimed is:

1. A polishing pad for use in a linear polisher comprising:

a pad body housing a top surface for engaging a surface to be polished and a bottom surface for mounting to a linear belt, said top surface having a center portion and two oppositely situated edge portions; and a multiplicity of voids situated in said top surface of the pad body such that said top surface having a void-to-surface ratio, said void-to-surface ratio being greater in said two edge portions than in said center portion of said top surface, said multiplicity of voids being a multiplicity of linear grooves comprising at least a first multiplicity of linear grooves in said edge portions and a second multiplicity of linear grooves in said center portion, said first multiplicity being larger than said second multiplicity.

2. A polishing pad for use in a linear polisher according to claim 1, wherein said pad body is formed of a polymeric material.

3. A polishing pad for use in a linear polisher according to claim 1, wherein said void-to-surface ratio is greater than 20% in said edge portions of said top surface and smaller than 20% in said center portion of said top surface.

4. A polishing pad for use in a linear polisher according to claim 1, wherein said multiplicity of linear grooves comprises at least a first multiplicity of linear grooves in said edge portions and a second multiplicity of linear grooves in said center portion, each of said first multiplicity of linear grooves having a width that is larger than a width of said second multiplicity of linear grooves.

5. A polishing pad for use in a linear polisher according to claim 1, wherein said multiplicity of linear grooves comprises at least a first multiplicity of linear grooves in said edge portions and a second multiplicity of linear grooves in said center portion, said first multiplicity of linear grooves and said second multiplicity of linear grooves have the same width.

6. A polishing pad for use in a linear polisher according to claim 1, wherein said multiplicity of linear grooves each having a depth smaller than a thickness of said pad body.

7. A polishing pad for use in a linear polisher according to claim 1, wherein said multiplicity of linear grooves each having a depth smaller than ½ of a thickness of said pad body.

8. A polishing pad for use in a linear polisher comprising:

a pad body housing a top surface for engaging a surface to be polished and a bottom surface for mounting to a linear belt, said top surface having a center portion and two oppositely situated edge portions; and a multiplicity of voids situated in said top surface of the pad body such that said top surface having a void-to-surface ratio, said void-to-surface ratio being greater in said two edge portions than in said center portion of said top surface, said multiplicity of voids being a multiplicity of apertures in said center portion, said first multiplicity being larger than said second multiplicity.

9. A polishing pad for use in a linear polisher according to claim 8, wherein each of said first multiplicity of apertures having a diameter larger than a diameter of said second multiplicity of apertures.

10. A polishing pad for use in a linear polisher according to claim 8, wherein said first multiplicity of apertures and said second multiplicity of apertures has the same diameter.

11. A polishing pad for use in a linear polisher according to claim 8, wherein said multiplicity of apertures is perforation through said pad body.

12. A polishing pad for use in a linear polisher according to claim 8, wherein said first multiplicity being larger than said second multiplicity each having a depth smaller than a thickness of said pad body.

13. A polishing pad for use in a linear polisher comprising:

a pad body housing a top surface for engaging a surface to be polished and a bottom surface for mounting to a linear belt, said top surface having a center portion and two oppositely situated edge portions; and a multiplicity of voids situated in said top surface of the pad body such that said top surface having a void-to-surface ratio, said void-to-surface ratio being greater in said two edge portions than in said center portion of said top surface, said multiplicity of voids being a multiplicity of protrusions in said edge positions and a second multiplicity of protrusions in said center portion, each of said first multiplicity of protrusions having an area smaller than an area of said second multiplicity of protrusions.

14. A polishing pad for use in a linear polisher according to claim 13, wherein a multiplicity of grooves formed in between said multiplicity of protrusions being a multiplicity of grooves formed in between a multiplicity of mesas.

15. A polishing pad for use in a linear polisher according to claim 13, wherein said multiplicity of protrusions each having a height of not greater than 3 mm.

16. A polishing pad for use in a linear polisher according to claim 13, wherein said first multiplicity being greater than said second multiplicity.

* * * * *